US010696508B2

(12) United States Patent
Kudo

(10) Patent No.: US 10,696,508 B2
(45) Date of Patent: Jun. 30, 2020

(54) SHEET CONVEYING APPARATUS

(71) Applicant: RISO KAGAKU CORPORATION, Tokyo (JP)

(72) Inventor: Kenji Kudo, Ibaraki (JP)

(73) Assignee: RISO KAGAKU CORPORATION, Tokyo (JP)

( * ) Notice: Subject to any disclaimer, the term of this patent is extended or adjusted under 35 U.S.C. 154(b) by 120 days.

(21) Appl. No.: 16/102,040

(22) Filed: Aug. 13, 2018

(65) Prior Publication Data

US 2019/0062095 A1 Feb. 28, 2019

(30) Foreign Application Priority Data

Aug. 30, 2017 (JP) ..... 2017-165506

(51) Int. Cl.

| | |
|---|---|
| ***B65H 29/12*** | (2006.01) |
| ***B65H 23/188*** | (2006.01) |
| ***B65H 5/06*** | (2006.01) |
| ***B65H 18/10*** | (2006.01) |
| ***B65H 23/192*** | (2006.01) |
| ***B65H 7/02*** | (2006.01) |
| ***B65H 43/00*** | (2006.01) |

(52) U.S. Cl.

CPC ..... *B65H 29/125* (2013.01); *B65H 5/062* (2013.01); *B65H 7/02* (2013.01); *B65H 18/103* (2013.01); *B65H 23/188* (2013.01); *B65H 23/1888* (2013.01); *B65H 23/192* (2013.01); *B65H 29/12* (2013.01); *B65H 43/00* (2013.01); *B65H 2403/46* (2013.01); *B65H 2404/143* (2013.01); *B65H 2404/1441* (2013.01); *B65H 2511/224* (2013.01); *B65H 2511/30* (2013.01); *B65H 2515/30* (2013.01); *B65H 2553/51* (2013.01); *B65H 2801/03* (2013.01); *B65H 2801/15* (2013.01)

(58) Field of Classification Search

CPC .. B65H 23/188; B65H 23/1888; B65H 29/12; B65H 29/125; B65H 5/062; B65H 18/103; B65H 7/02; B65H 43/00

USPC ..... 226/176

See application file for complete search history.

(56) References Cited

U.S. PATENT DOCUMENTS

2008/0157465 A1* 7/2008 Matsumoto ..... B65H 5/062 271/277

2016/0136981 A1* 5/2016 Suzuki ..... B41J 11/70 347/104

FOREIGN PATENT DOCUMENTS

JP 08259068 A * 10/1996

* cited by examiner

*Primary Examiner* — William E Dondero

(74) *Attorney, Agent, or Firm* — Greenblum & Bernstein, P.L.C.

(57) ABSTRACT

A conveying apparatus includes: a first roller and a second roller configured to convey a print sheet while nipping the print sheet at a nip pressure; an adjustor supporting the first roller and the second roller in a manner capable of adjusting an inter-axial distance between the first roller and the second roller, the adjustor being configured to apply a biasing force biasing the second roller toward the first roller and capable of adjusting the biasing force; and a controller configured to control the nip pressure by driving the adjustor to adjust the biasing force.

8 Claims, 6 Drawing Sheets

SHEET CONVEYING APPARATUS

CROSS REFERENCE TO RELATED APPLICATION

This application is based upon and claims the benefit of priority from the prior Japanese Patent Application No. 2017-165506, filed on Aug. 30, 2017, the entire contents of which are incorporated herein by reference.

BACKGROUND

1. Technical Field

The disclosure relates to a conveying apparatus which conveys a print sheet.

2. Related Art

A printing apparatus which performs printing on a long web as a print medium while conveying the web is known. In such a printing apparatus, it is important to apply appropriate tension to the web to prevent generation slack and wrinkles in the web, occurrence of variation in web conveyance speed, occurrence of retransfer of inks by a conveyance roller, and the like.

Japanese Patent Application Publication No. H08-259068 proposes use of a pair of following rollers for a pair of back tension rollers which apply back tension to a conveyed web with perforations, the following rollers configured to rotate about with rotational axes tilted relative to the rotational axis of the back tension rollers as the drive rollers.

In the aforementioned proposal, positions where the perforations interfere with both pairs of rollers are gradually moved from the center side to outer end sides of the web in the width direction thereof. An impact generated by the perforations passing the pair of back tension rollers is thereby temporally distributed, so that the impact generated at one time is reduced and accordingly prevented from causing variation in web conveyance speed.

SUMMARY

The aforementioned proposal is a technique for stabilizing the conveyance speed when the perforations pass the pair of rollers applying the tension to the web and is not a technique for causing a pair of rollers to apply appropriate tension to the web.

The disclosure is directed to a conveying apparatus which can apply appropriate tension to a conveyed print sheet such as a web or cut sheets.

A conveying apparatus in accordance with some embodiments includes: a first roller and a second roller configured to convey a print sheet while nipping the print sheet at a nip pressure; an adjustor supporting the first roller and the second roller in a manner capable of adjusting an inter-axial distance between the first roller and the second roller, the adjustor being configured to apply a biasing force biasing the second roller toward the first roller and capable of adjusting the biasing force; and a controller configured to control the nip pressure by driving the adjustor to adjust the biasing force.

In the aforementioned configuration, appropriate tension can be applied to the conveyed print sheet.

DETAILED DESCRIPTION

Figure 1:
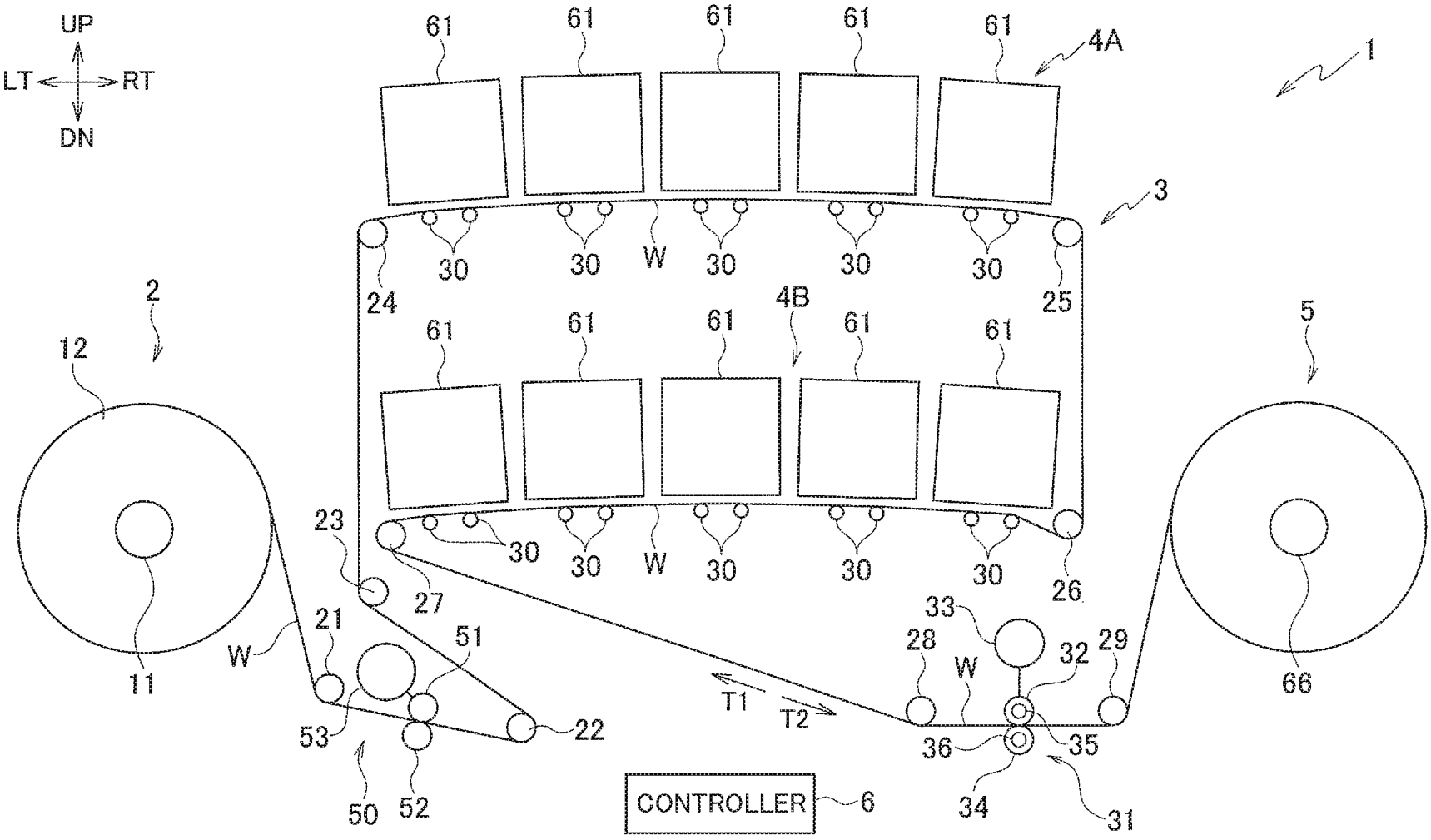
FIG. 1 is an explanatory view illustrating a schematic configuration of a printing apparatus according to one embodiment.

In the following detailed description, for purposes of explanation, numerous specific details are set forth in order to provide a thorough understanding of the disclosed embodiments. It will be apparent, however, that one or more embodiments may be practiced without these specific details. In other instances, well-known structures and devices are schematically shown in order to simplify the drawing.

Description will be hereinbelow provided for embodiments of the present invention by referring to the drawings. It should be noted that the same or similar parts and components throughout the drawings will be denoted by the same or similar reference signs, and that descriptions for such parts and components will be omitted or simplified. In addition, it should be noted that the drawings are schematic and therefore different from the actual ones.

Figure 2:
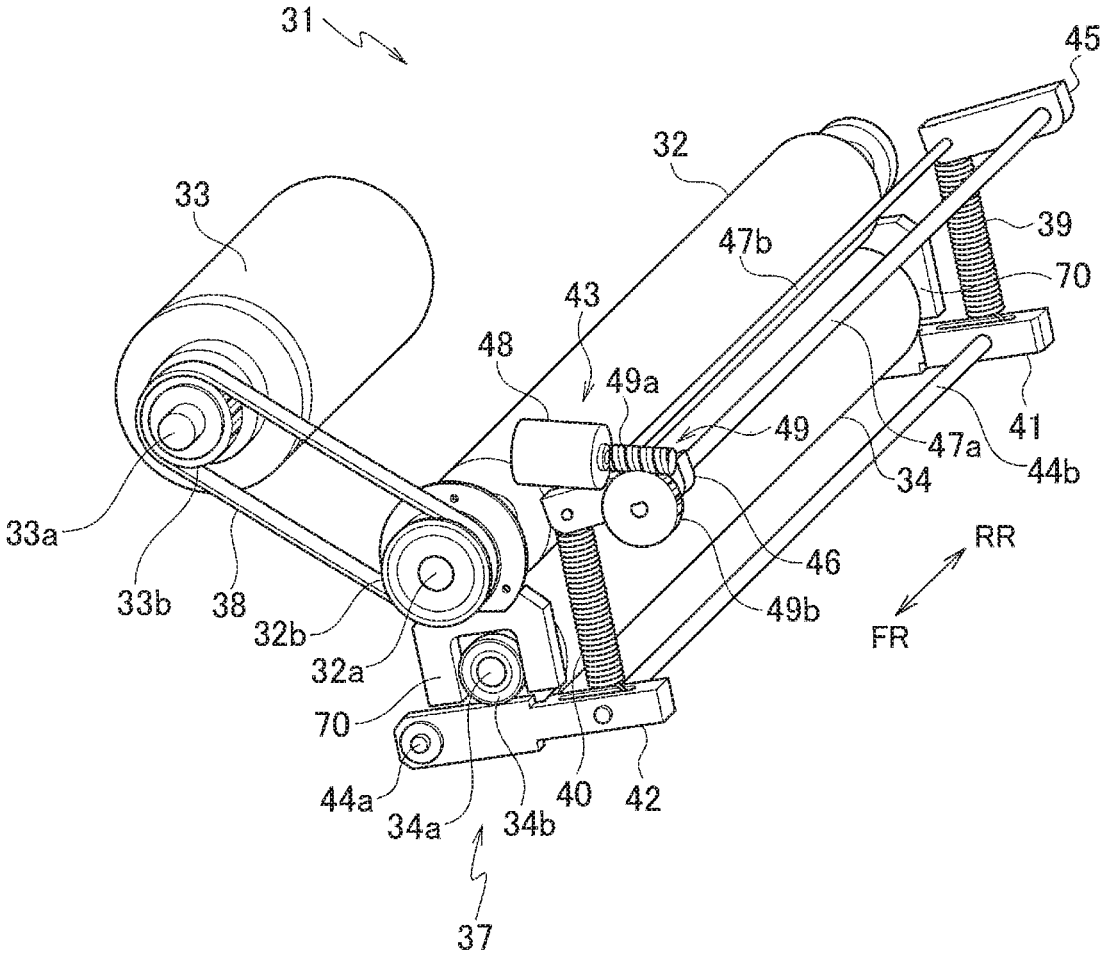
FIG. 2 is a perspective view of a conveyance unit of FIG. 1.
Figure 3:
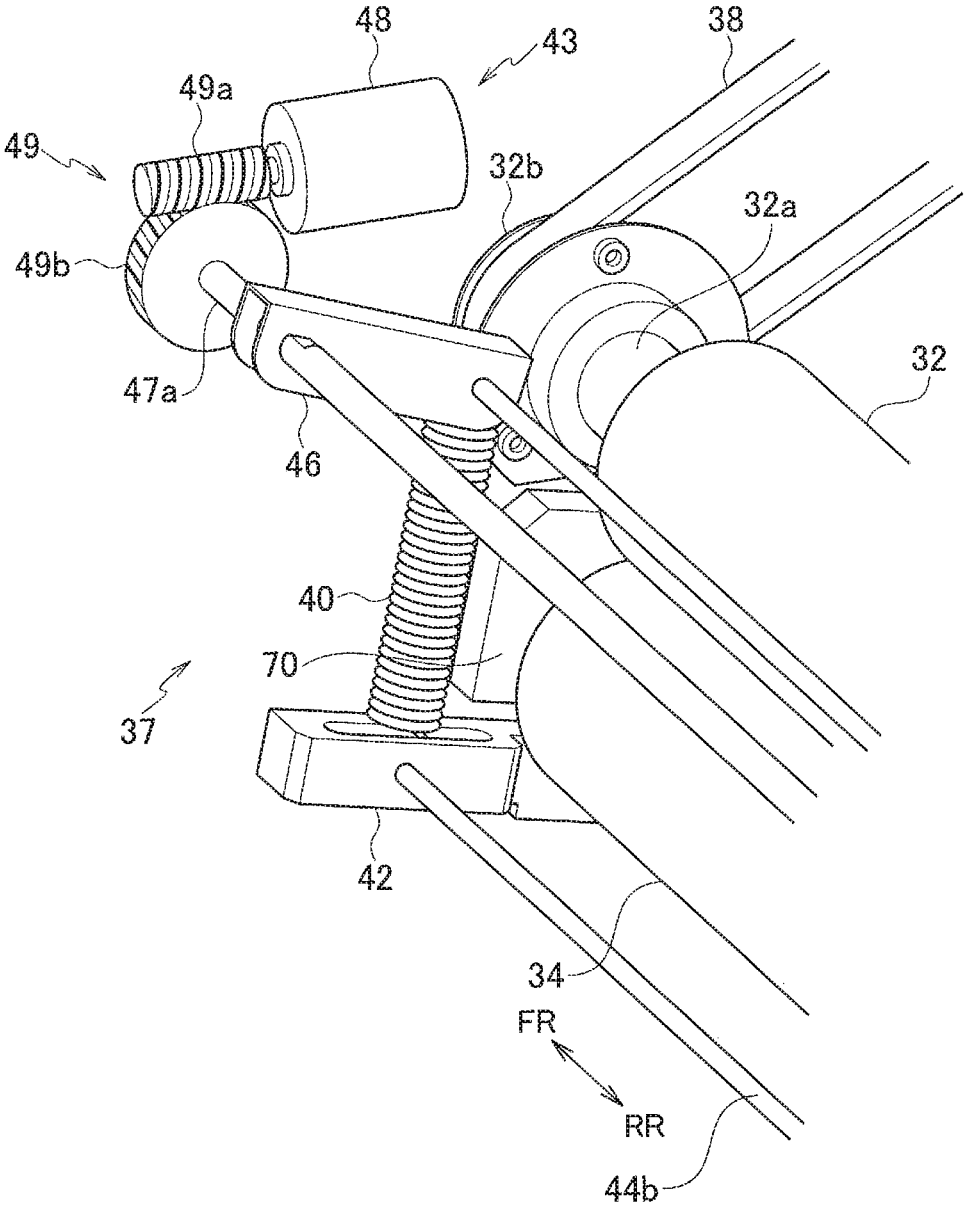
FIG. 3 is an enlarged perspective view illustrating a nip pressure adjustment mechanism of FIG. 2.

FIG. 1 is an explanatory view illustrating a schematic configuration of a printing apparatus 1 according to one embodiment of the present invention. Note that, in the following description, a direction orthogonal to the sheet surface of FIG. 1 is referred to as a front-rear direction and a direction from the sheet surface toward a viewer is referred to as a front direction. Moreover, up, down, left, and right in the sheet surface of FIG. 1 are referred to as up, down, left, and right directions. In FIGS. 1 to 3, the right, left, up, down, front, and rear directions are denoted by RT, LT, UP, DN, FR, and RR, respectively.

As illustrated in FIG. 1, the printing apparatus 1 includes an unwinder 2, a conveyor 3, printers 4A and 4B, a rewinder 5, and a controller 6. Note that the conveyor 3 and the controller 6 form a conveying apparatus.

The unwinder 2 holds a web W to be unwound to the conveyor 3. The web W is a long print medium made of a film, paper, or the like. The unwinder 2 includes a web roll support shaft 11.

The web roll support shaft 11 rotatably supports a web roll 12. The web roll 12 is a roll of the web W. The web roll support shaft 11 is formed in a long shape extending in the front-rear direction.

The conveyor 3 conveys the web W unwound from the unwinder 2. The conveyor 3 includes guide rollers 21 to 29, twenty under-head support members 30, a conveyance unit 31, and a brake unit 50.

The guide rollers 21 to 29 guide the web W conveyed in the conveyor 3. The guide rollers 21 to 29 rotate by following the conveyed web W. The guide rollers 21 to 29 are formed in a long shape extending in the front-rear direction.

The guide roller 21 guides the web W fed from the unwinder 2 to the brake unit 50. The guide roller 21 is arranged near the unwinder 2.

The guide rollers 22 to 28 guide the web W between the brake unit 50 and the conveyance unit 31. Among these rollers, the guide rollers 22 to 24 guide the web W having passed the brake unit 50 to the printer 4A. The guide rollers 25 and 26 guide the web W having passed the printer 4A to the printer 4B. The guide rollers 27 and 28 guide the web W having passed the printer 4B to the conveyance unit 31. The guide roller 29 guides the web W having passed the conveyance unit 31 to the rewinder 5.

The under-head support members 30 support the web W below later-described head units 61 between the guide rollers 24 and 25 and between the guide rollers 26 and 27, each of the printers 4A and 4B provided with five head units 61. The under-head support members 30 are formed in a long shape extending in the front-rear direction. Ten under-head support members 30 are arranged in each of an area between the guide rollers 24 and 25 and an area between the guide rollers 26 and 27. Moreover, two under-head support members 30 are arranged right below each head unit 61. In each of the area between the guide rollers 24 and 25 and the area between the guide rollers 26 and 27, the ten under-head support members 30 are arranged such that the web W forms an arch shape protruding upward.

The conveyance unit 31 sends out the web W toward the rewinder 5 at a conveyance speed determined by the controller 6, and includes a conveyance roller 32 rotationally driven by a conveyance motor 33, a following roller 34, an encoder 35 (conveyance roller encoder), an encoder (following roller encoder) 36, and a nip pressure adjustment mechanism 37 (see FIG. 2).

As illustrated in FIG. 2, pulleys 32*b*, 33*b* are attached respectively to a rotary shaft 32*a* of the conveyance roller 32 and an output shaft 33*a* of the conveyance motor 33. A belt 38 is wound around the pulleys 32*b*, 33*b*. The conveyance roller is rotated by a rotation force transmitted from the conveyance motor 33 via the belt 38 and the pulleys 32*b*, 33*b*.

Figure 4:
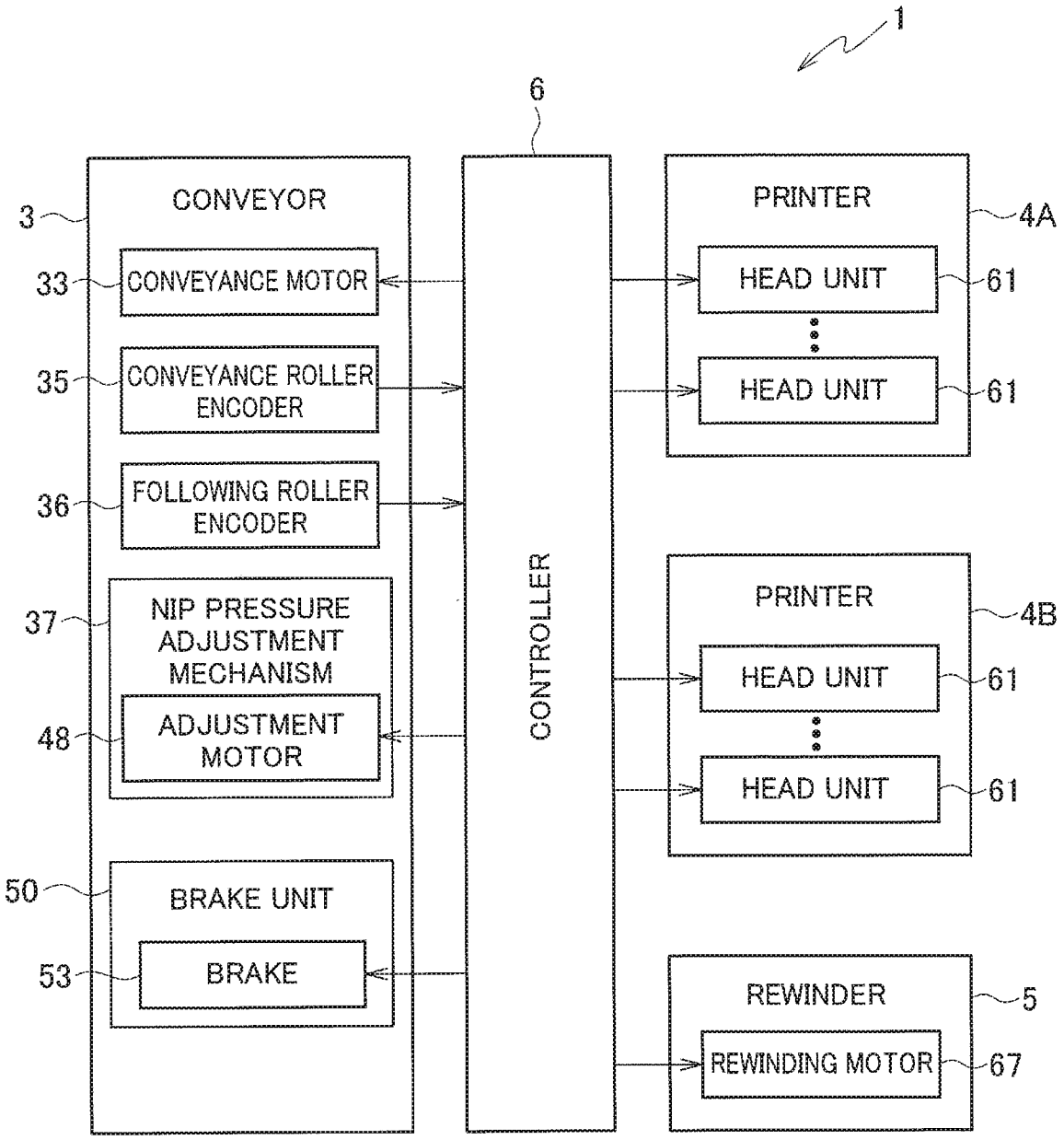
FIG. 4 is a block diagram illustrating a configuration of a control system of the printing apparatus in FIG. 1.

The conveyance roller 32 and the following roller 34 nip the web Wand adjust the conveyance speed of the web W conveyed by the rotation force of the conveyance motor 33, to a determined speed. The conveyance roller 32 and the following roller 34 are formed in columnar shapes elongated in the front-rear direction and have the same radius. Note that a rewinding motor 67 (see FIG. 4) which rotates a later-described rewinding shaft 66 of the rewinder 5 applies tension T1 in a reverse direction toward the unwinder 2, to the conveyed web W.

The encoder 35 is connected to the conveyance roller 32 and the encoder 36 is connected to the following roller 34. The encoder 35 outputs a pulse signal each time the conveyance roller 32 is at a prescribed rotation angle. The encoder 36 outputs a pulse signal each time the following roller 34 is at a prescribed rotation angle.

The nip pressure adjustment mechanism 37 adjusts a contact pressure of the following roller 34 on the conveyance roller 32, and includes pressure application springs 39 and 40, pressure application arms 41 and 42, guides 70, and an adjustor 43.

The pressure application springs 39 and 40 apply biasing forces which bias the following roller 34 toward the conveyance roller 32 by pulling, respectively, swinging ends of the pressure application arms 41 and 42 which swing about a supporting shaft 44*a*, and bring the following roller 34 into pressure contact with the conveyance roller 32.

One end of the pressure application spring 39 is attached to the swinging end of the pressure application arm 41 on the rear side and the other end of the pressure application spring 39 is attached to a swinging end of an adjustment arm 45 which swings about a supporting shaft 47*a*. The spring force of the pressure application spring 39 thus changes depending on the swinging of the adjustment arm 45 about the supporting shaft 47*a*.

One end of the pressure application spring 40 is attached to the swinging end of the pressure application arm 42 on the front side and the other end of the pressure application spring 40 is attached to one end portion of an adjustment arm 46 which swings about the supporting shaft 47*a*. The spring force of the pressure application spring 40 thus changes depending on the swinging of the adjustment arm 46 about the supporting shaft 47*a*.

The swinging ends of the adjustment arms 45 and 46 are connected to each other by a link bar 47*b*. Accordingly, the adjustment arms 45 and 46 swing integrally in conjunction. The adjustment arms 45 and 46 which swing in conjunction thereby set the spring forces of the pressure application springs 39 and 40 to the same force.

The swinging ends of the pressure application arms 41 and 42 are connected to each other by a link bar 44*b*. Accordingly, the pressure application arms 41 and 42 swing integrally in conjunction.

The pressure application arm 41 presses a bearing member (not illustrated) supporting a rotary shaft 34*a* behind the following roller 34 to press a rear end portion of the following roller 34 toward the conveyance roller 32.

The pressure application arm 42 presses a bearing member 34*b* supporting a rotary shaft 34*a* in front of the following roller 34 to press a front end portion of the following roller 34 toward the conveyance roller 32.

The guides 70 guide the bearing member (not illustrated) behind the following roller 34 and the bearing member 34*b* in front of the following roller 34 such that the bearing members can slide in directions in which the following roller 34 moves toward and away from the conveyance roller 32. The swinging of the pressure application arm 41 and the pressure application arm 42 enables adjustment of the distance (inter-axial distance) between the rotary shaft 32*a* of the conveyance roller 32 and the rotary shaft 34*a* of the following roller 34.

The web roll support shaft 11, the rewinding shaft 66, the rotary shaft 32*a*, the output shaft 33*a*, the supporting shaft 44*a*, and the supporting shaft 47*a* are rotatably supported on a case or the like of the printing apparatus 1. The rewinding motor 67, the conveyance motor 33, an adjustment motor 48 to be described later, and the guides 70 are fixed to the case or the like of the printing apparatus 1.

The spring forces of the pressure application springs 39 and 40 applied to the swinging ends of the pressure application arms 41 and 42 cause the pressure application arms 41 and 42 to press the following roller 34 toward the conveyance roller 32.

Changing the spring forces of the pressure application springs 39 and 40 by means of swinging the adjustment arms 45 and 46 changes the contact pressure of the following roller 34 on the conveyance roller 32. A nip pressure applied to the web W by the conveyance roller 32 and the following roller 34 can be thereby changed.

The adjustor 43 adjusts the nip pressure applied to the web W by the conveyance roller 32 and the following roller 34 by swinging the adjustment arm 46 on the front side.

The adjustor 43 includes an adjustment motor 48 and a worm gear 49 (worm 49*a* and worm wheel 49*b*) as illustrated in an enlarged perspective view of FIG. 3.

The adjustment motor 48 generates a drive force for swinging the adjustment arms 45 and 46 via the supporting shaft 47*a*. For example, a stepper motor, a DC motor, or the like can be used as the adjustment motor 48.

The worm gear 49 swings the adjustment arms 45 and 46 integrally by causing the worm 49*a* attached to an output shaft of the adjustment motor 48 to rotate the supporting shaft 47*a* via the worm wheel 49*a* in mesh with the worm 49*a*.

Accordingly, the adjustor 43 changes the spring forces of the pressure application springs 39 and 40 by causing the adjustment motor 48 to swing the adjustment arms 45 and 46 and thereby adjusts the nip pressure applied to the web W by the conveyance roller 32 and the following roller 34.

The brake unit 50 illustrated in FIG. 1 applies a braking force, that is tension T2 in a forward direction toward the rewinder 5, to the web W sent out from the unwinder 2 to the printer 4A. The brake unit 50 includes a brake roller 51, a pressure application roller 52, and a brake 53.

The brake roller 51 and the pressure application roller 52 form a pair of rollers which nips the web Wand which applies tension to the conveyed web W by using the braking force of the brake 53. The brake roller 51 and the pressure application roller 52 are formed in cylindrical shapes elongated in the front-rear direction.

The brake 53 generates the braking force for applying tension to the web W. The brake 53 is connected to the brake roller 51 via a not-illustrated brake belt. For example, a powder brake which generates the braking force by using an electro-magnetic clutch utilizing magnetic iron powder can be used as the brake 53.

The printers 4A and 4B print images respectively on a front surface and a back surface of the web W, respectively. The printer 4A is arranged above and near the web W between the guide rollers 24 and 25. The printer 4B is arranged above and near the web W between the guide rollers 26 and 27. The printers 4A and 4B each include five head units 61.

The head units 61 include inkjet heads (not illustrated) and print images by ejecting inks from nozzles of the inkjet heads to the web W. In each of the printers 4A and 4B, the colors of the inks ejected respectively from the five head units 61 are different from one another.

The rewinder 5 rewinds the web W subjected to printing by the printers 4A and 4B. The rewinder 5 includes a rewinding shaft 66 and a rewinding motor 67 (see FIG. 4).

The rewinding shaft 66 rewinds and holds the web W. The rewinding shaft 66 is formed in a long shape extending in the front-rear direction.

The rewinding motor 67 rotates the rewinding shaft 66. The rotation of the rewinding shaft 66 causes the web W to be rewound on the rewinding shaft 66 and the tension T1 in the reverse direction toward the unwinder 2 is applied to the rewound web W.

The controller 6 controls operations of the entire printing apparatus 1. The controller 6 includes a CPU, a RAM, a ROM, a hard disk drive, and the like. As illustrated in the block diagram of FIG. 4, the conveyance motor 33 of the conveyor 3, the encoders 35 and 36 respectively of the conveyance roller 32 and the following roller 34, the brake 53 of the brake unit 50, the head units 61 of the printers 4A and 4B, and the rewinding motor 67 of the rewinder 5 are connected to the controller 6.

In the case of performing a printing operation, the controller 6 drives the head units 61 of the printers 4A and 4B to print images on the web W while driving the conveyance motor 33 and the rewinding motor 67 to convey the web W.

Moreover, every time a nip pressure adjustment condition is satisfied, the controller 6 adjusts the nip pressure applied to the web W by the conveyance roller 32 and the following roller 34 of the conveyance unit 31, by using the nip pressure adjustment mechanism 37.

Note that, in the embodiment, the nip pressure adjustment condition is assumed to be satisfied, for example, when the web roll 12 set on the web roll support shaft 11 of the unwinder 2 is replaced. Moreover, in the embodiment, the nip pressure adjustment condition is assumed to be satisfied every time the controller 6 receives a print job using the web W, after the setting of the web roll 12 on the web roll support shaft 11 of the unwinder 2.

Steps of nip pressure adjustment processing performed by the CPU of the controller 6 according to a program stored in the ROM when the web roll 12 is replaced are described with reference to the flowchart of FIG. 5.

First, the replacement of the web roll 12 on the web roll support shaft 11 triggers the start of the nip pressure adjustment processing by the CPU of the controller 6.

The CPU of the controller 6 causes the adjustment motor 48 of the nip pressure adjustment mechanism 37 to change the spring forces of the pressure application springs 39 and 40. The CPU of the controller 6 thereby sets the nip pressure applied to the web W by the conveyance roller 32 and the following roller 34 to a nip pressure at start of adjustment (step S1).

In this case, in order to nip the web W with the conveyance roller 32 and the following roller 34 at an appropriate pressure, the nip pressure N needs to be set to a value satisfying a relationship of $\mu N \geq T1 - T2$ with parameters of the friction coefficient μ of the web W, the tension T1 in the reverse direction toward the unwinder 2 applied to the web W, and the tension T2 in the forward direction toward the rewinder 5 applied to the web W.

The difference (T1−T2) between the tensions T1 and T2 in this relational expression is always a constant value because torque generated by the rewinding motor 67 of the rewinder 5 and torque generated by the brake 53 of the brake unit 50 are controlled by the CPU of the controller 6 to be constant. Accordingly, the nip pressure N applied to the web W by the conveyance roller 32 and the following roller 34 needs to be adjusted depending on the friction coefficient μ of the web W.

The friction coefficient μ of a thick web W with large basis weight is greater than that of a thin web W with small basis weight. Accordingly, the nip pressure N at which the web W can be nipped at an appropriate pressure can be defined by using the basis weight of the web W instead of the friction coefficient μ of the web W.

The CPU of the controller 6 determines the nip pressure to be applied to the web W by the conveyance roller 32 and the following roller 34 at the start of adjustment to be a nip pressure close to the appropriate nip pressure Nt (nip pressure slightly lower than the appropriate nip pressure Nt) at which the aforementioned relationship is satisfied.

In this case, the CPU of the controller 6 selects the nip pressure at the start of adjustment from multiple nip pressure candidates (nip pressures N1, N2, N3, . . . ). The CPU of the controller 6 determines which one of the candidates is to be the nip pressure at the start of adjustment, based on the friction coefficient μ of the web W or the basis weight corresponding to the friction coefficient μ.

Accordingly, in the replacement of the web roll 12, the CPU of the controller 6 obtains information on the type of the web W of the new web roll 12 and the like which allows the CPU to determine the friction coefficient μ of the web W or the basis weight corresponding to the friction coefficient μ. Then, the CPU of the controller 6 selects the nip pressure at the start of adjustment from multiple nip pressure candidates (nip pressures N1, N2, N3, . . . ) based on the obtained information and sets the nip pressure at the start of adjustment to the selected nip pressure in step S1.

Next, the CPU of the controller 6 controls the conveyance motor 33 and the rewinding motor 67 to start conveyance of the web W (step S3). After the start of conveyance, the conveyance speed of the web W is increased to a prescribed speed.

In this case, when one of the conveyance roller 32 and the following roller 34 nipping the web W slips on the web W, the nipping of the web W by the conveyance roller 32 and the following roller 34 is imperfect.

Moreover, when the nipping of the web W by the conveyance roller 32 and the following roller 34 is imperfect, the nip pressure applied to the web W is smaller than the appropriate nip pressure corresponding to the friction coefficient μ of the web W.

Accordingly, the CPU of the controller 6 detects whether one of the conveyance roller 32 and the following roller 34 slips on the web W or not. This slipping can be determined by determining whether the difference between the rotation amount of the conveyance roller 32 and the rotation amount of the following roller 34 is within a prescribed range. Specifically, the CPU of the controller 6 can determine that there is no slipping when the rotation amount difference is within the prescribed range and determine that there is slipping when the rotation amount difference exceeds the prescribed range.

Thus, the CPU of the controller 6 obtains outputs (ENC1, ENC2) of the encoders 35 and 36 of the conveyance roller 32 and the following roller 34 and compares the numbers of pulses in the respective outputs ENC1 and ENC2 to determine (check) whether the numbers are approximately the same (ENC1≈ENC2) (step S5).

When the difference between the rotation amount of the conveyance roller 32 and the rotation amount of the following roller 34 is within the prescribed range, the numbers of pulses in the respective outputs (ENC1, ENC2) of the encoders 35 and 36 are approximately or exactly the same. Meanwhile, when the difference between the rotation amount of the conveyance roller 32 and the rotation amount of the following roller 34 is not within the prescribed range, the numbers of pulses in the respective outputs ENC1 and ENC2 are not approximately the same.

Note that, in the case of determining whether the numbers of pulses in the respective outputs ENC1 and ENC2 are approximately the same, in the embodiment, the CPU of the controller 6 obtains the outputs ENC1 and ENC2 of the encoders 35 and 36 per second, three times. The outputs ENC1 and ENC2 of the encoders 35 and 36 per second correspond to outputs of the encoders 35 and 36 while the conveyance roller 32 and the following roller 34 in the embodiment make 3.7 rotations.

The aforementioned value is calculated based on the fact that the conveyance roller 32 and the following roller 34 both have a roller diameter of 60 mm and convey the web W 700 mm per second.

Then, the CPU of the controller 6 counts the total numbers of pulses in the respective outputs ENC1 and ENC2 obtained three times and determines that the numbers of pulses in the respective outputs ENC1 and ENC2 are approximately the same (ENC1≈ENC2) when the difference between the counted total numbers is equal to or smaller than a reference value.

The aforementioned reference value may be set to such a pulse number difference that, for example, when the conveyance roller 32 and the following roller 34 convey the web W at a prescribed speed for printing images on the web W at a resolution of 300 dots per inch (dpi), the difference in circulation distance between the conveyance roller 32 and the following roller 34 is 0.1 mm or less (for example, set to a difference of one pulse or less). This value is also calculated based on the aforementioned roller diameter (60 mm) of the conveyance roller 32 and the following roller 34 and the conveyance speed (700 mm/sec) of the web W.

When the CPU of the controller 6 does not determine that the numbers of pulses in the respective outputs ENC1 and ENC2 are approximately the same (ENC1≈ENC2) (NO in step S5), the CPU of the controller 6 increases the nip pressure N applied to the web W by the conveyance roller 32 and the following roller 34 in stages (N2→N3→ . . . →Nn→ . . . ) (step S7) and then returns to the processing of step S5.

Meanwhile, when the CPU of the controller 6 determines that the numbers of pulses in the respective outputs ENC1 and ENC2 are approximately the same (ENC1≈ENC2) (YES in step S5), the CPU of the controller 6 sets the nip pressure N applied to the web W by the conveyance roller 32 and the following roller 34 to an appropriate nip pressure Nt which is a sum of an adjustment pressure α and a current nip pressure Ns (step S9) and continues the conveyance of the web W.

Here, the adjustment pressure α can be determined by using, as a guide, for example, a degree of variation (variation width) in the difference between the outputs ENC1 and ENC2 of the encoders 35 and 36 of the conveyance roller 32 and the following roller 34 in the case where the entire web W of one web roll 12 is conveyed at a prescribed speed while the nip pressure N applied to the web W by the conveyance roller 32 and the following roller 34 is maintained at the nip pressure Ns at which the outputs ENC1 and ENC2 of the encoders 35 and 36 of the conveyance roller 32 and the following roller 34 are approximately the same.

Specifically, the entire web W of one web roll 12 is conveyed at the prescribed speed while the nip pressure N applied to the web W by the conveyance roller 32 and the following roller 34 is maintained at the nip pressure Ns by the control of the CPU of the controller 6. Then, the difference between the nip pressure Ns applied to the web W at the start of the nip pressure adjustment processing and the nip pressure N applied to the web W when the difference between the outputs ENC1 and ENC2 of the encoders 35 and 36 obtained during the conveyance of the web W is greatest is set as the value (adjustment value) of the adjustment pressure α to be added to the nip pressure Ns.

The adjustment pressure α may be updated to a new value every time the CPU of the controller 6 determines the degree of variation (variation width) in the difference between the outputs ENC1 and ENC2 of the encoders 35 and 36 of the conveyance roller 32 and the following roller 34 during the conveyance of the entire web W of one web roll 12.

Moreover, after the number of times the CPU of the controller 6 determines the value of the adjustment pressure α based on the degree of variation (variation width) in the difference between the outputs ENC1 and ENC2 of the encoders 35 and 36 of the conveyance roller 32 and the following roller 34 reaches a certain number, the CPU of the controller 6 may determine a fixed value of the adjustment pressure α to be used hereafter, based on the value of the adjustment pressure α determined in the past by the CPU of the controller 6, without actually measuring the degree of variation (variation width) in the difference between the outputs ENC1 and ENC2 of the encoders 35 and 36.

Specifically, for example, the latest adjustment pressure α determined by the CPU of the controller 6 may be set as the fixed value of the adjustment pressure α to be used hereafter or the maximum value of the adjustment pressure α determined in the past may be set as the fixed value of the adjustment pressure α to be used hereafter.

Moreover, the CPU of the controller 6 may determine the adjustment pressure α to be applied in a current operation by performing estimation based on a trend of variation in the adjustment pressure α determined in the past by the CPU of the controller 6.

In this case, the CPU of the controller 6 analyzes the trend of variation in the adjustment pressure α (for example, slight linear increase or the like) based on, for example, the adjustment pressures α determined by the CPU of the controller 6 in a certain period extending back from now or the adjustment pressures α determined by the CPU of the controller 6 in a certain number of latest determination operations. Then, the CPU of the controller 6 can determine the adjustment pressure α to be applied in the current operation by performing estimation based on this analysis result (or this analysis result and the latest adjustment pressure α determined in the past).

Then, upon completion of the conveyance of the web W by a prescribed conveyance amount for the replacement of the web roll 12 on the web roll support shaft 11 (step S11), the CPU of the controller 6 terminates the series of steps of the nip pressure adjustment processing.

Figure 6:
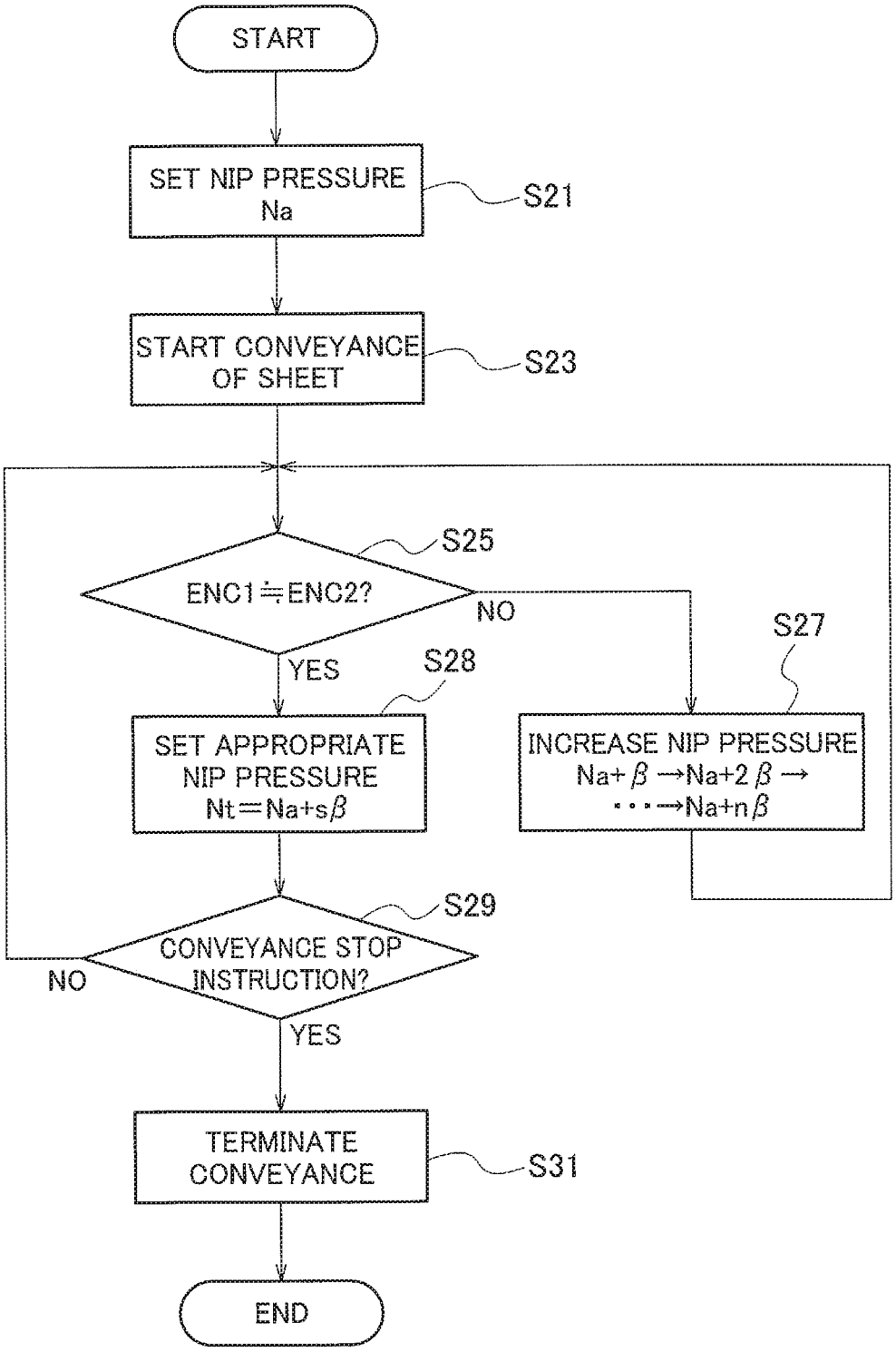
FIG. 6 is a flowchart illustrating steps of the nip pressure adjustment processing in the conveyance unit performed by the controller of FIG. 4.

Next, with reference to the flowchart of FIG. 6, description is given of steps of the nip adjustment processing performed by the CPU of the controller 6 according to a program stored in a ROM upon receiving the print job, as preparation processing performed prior to execution of the print job.

First, the reception of the print job triggers the start of the nip pressure adjustment processing by the CPU of the controller 6.

The CPU of the controller 6 causes the adjustment motor 48 of the nip pressure adjustment mechanism 37 to change the spring forces of the pressure application springs 39 and 40. The CPU of the controller 6 thereby sets the nip pressure applied to the web B by the conveyance roller 32 and the following roller 34 to a current nip pressure Na (step S21).

The current nip pressure Na is a value of the latest appropriate nip pressure Nt determined in the past by the CPU of the controller 6.

Next, the CPU of the controller 6 controls the conveyance motor 33 and the rewinding motor 67 to start conveyance of the web W (step S23). After the start of conveyance, the conveyance speed of the web W is increased to a prescribed speed.

Figure 5:
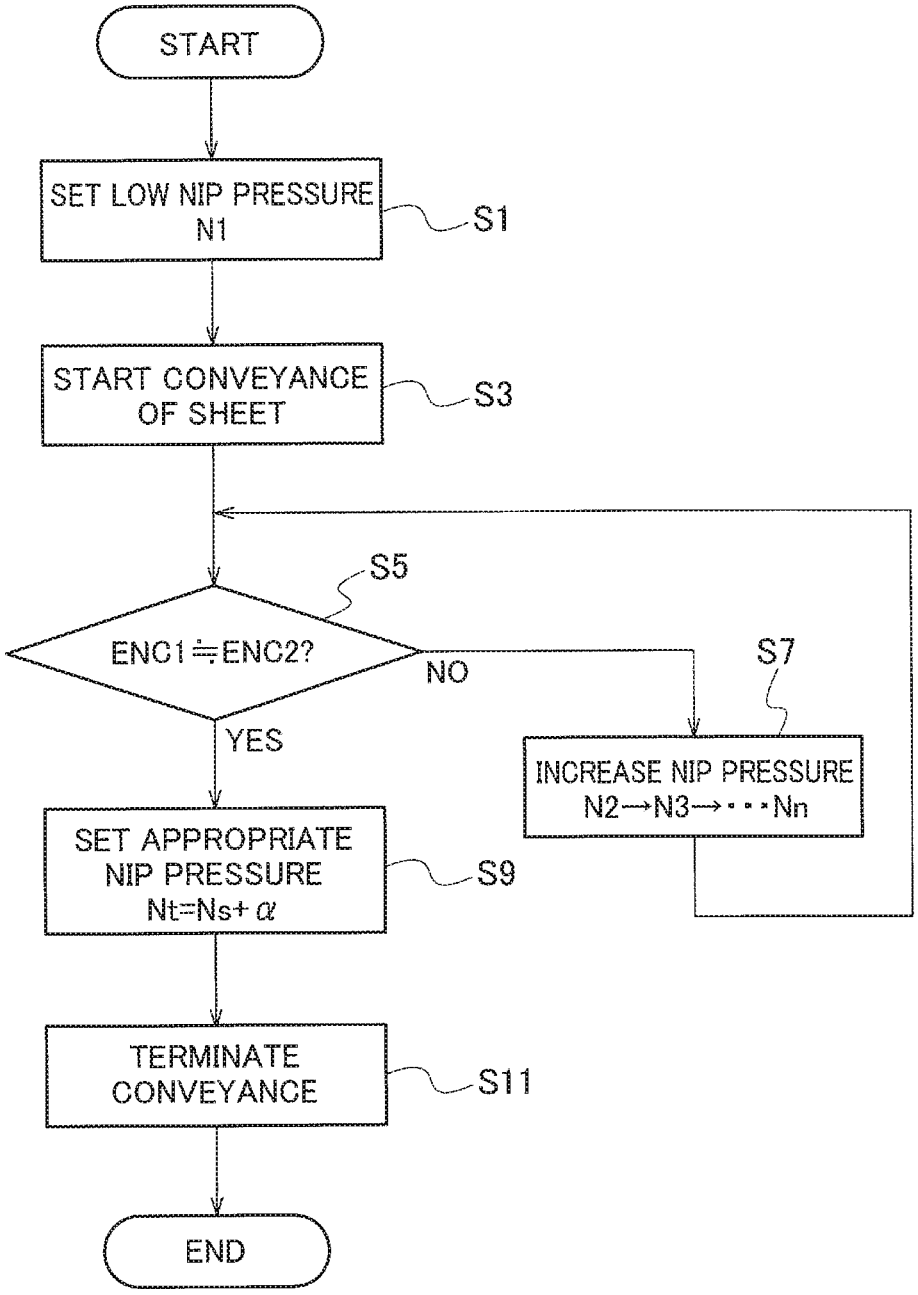
FIG. 5 is a flowchart illustrating steps of nip pressure adjustment processing in the conveyance unit performed by a controller of FIG. 4.

Then, the CPU of the controller 6 obtains the outputs (ENC1, ENC2) of the encoders 35 and 36 of the conveyance roller 32 and the following roller 34 and determines (check) whether the numbers of pulses in the respective outputs ENC1 and ENC2 are approximately the same (ENC1≈ENC2) (step S25) as in the nip pressure adjustment processing performed in the replacement of the web roll 12 (step S5 of FIG. 5).

When the CPU of the controller 6 does not determine that the numbers of pulses in the respective outputs ENC1 and ENC2 are approximately the same (ENC1≈ENC2) (NO in step S25), the CPU of the controller 6 increases the nip pressure N applied to the web W by the conveyance roller 32 and the following roller 34 in stages (Na+β→Na+2β→ . . . →Na+nβ) (step S27) and then returns to the processing of step S25.

Meanwhile, when the CPU of the controller 6 determines that the numbers of pulses in the respective outputs ENC1 and ENC2 are approximately the same (ENC1≈ENC2) (YES instep S25), the CPU of the controller 6 sets the current nip pressure Na+sβ as the appropriate nip pressure Nt (step S28) and continues the conveyance of the web W.

Then, the CPU of the controller 6 repeats the adjustment of the nip pressure N applied to the web W by the conveyance roller 32 and the following roller 34, based on the comparison between the outputs ENC1 and ENC2 of the encoders 35 and 36 of the conveyance roller 32 and the following roller 34 (steps S25, S27, S28) until the conveyance of the web W for print job start preparation is completed (NO in step S29).

When an instruction to stop the conveyance of the web W for the print job start preparation is generated (YES in step S29), the CPU of the controller 6 terminates the conveyance of the web W (step S31) and then terminates the series of steps of the nip pressure adjustment processing.

Note that, in consideration of the fact that the nip pressure N applied to the web W is adjusted to an appropriate nip pressure Na+sβ by increasing the nip pressure N in stages (Na+β→Na+2β→ . . . →Na+nβ) in the nip pressure adjustment processing performed upon reception of the print job, the adjustment processing of the nip pressure N applied to the web W may be started from a nip pressure Na-γ which is smaller than the current nip pressure Na by an offset amount γ to facilitate the adjustment of the nip pressure N.

In this case, the amount (sβ) by which the nip pressure N is increased in stages until the outputs ENC1 and ENC2 of the encoders 35 and 36 of the conveyance roller 32 and the following roller 34 become approximately the same (ENC1≈ENC2) may exceed the aforementioned offset amount γ.

As described above, in the nip pressure adjustment processing performed upon reception of the print job as the preparation processing prior to execution of the print job, the nip pressure N applied to the web W by the conveyance roller 32 and the following roller 34 is repeatedly adjusted during the conveyance of the web W. Accordingly, the adjustment pressure α as in the nip pressure adjustment processing performed in the replacement of the web roll 12 does not have to be added to the current nip pressure Na+sβ determined as the appropriate nip pressure Nt when the numbers of pulses in the respective outputs ENC1 and ENC2 of the encoders 35 and 36 of the conveyance roller 32 and the following roller 34 are determined to be approximately the same (ENC1≈ENC2).

The printing apparatus 1 of the embodiment described above compares the rotation amount of the conveyance roller 32 rotationally driven by the conveyance motor 33 of the conveyance unit 31 with the rotation amount of the following roller 34 which rotates to follow the conveyance roller 32 by being brought into pressure contact therewith, based on the outputs ENC1 and ENC2 of the encoders 35 and 36 connected respectively to the conveyance roller 32 and the following roller 34.

Moreover, assuming that the rotation amounts of the conveyance roller 32 and the following roller 34 are the same when the numbers of pulses in the respective outputs ENC1 and ENC2 of the encoders 35 and 36 are determined to be approximately the same (ENC1≈ENC2), the printing apparatus 1 determines the appropriate nip pressure Nt applied to the web W by the conveyance roller 32 and the following roller 34, based on the nip pressures Ns and Na+sβ at that moment.

Accordingly, the printing apparatus 1 can adjust the nip pressure applied to the web W by the conveyance roller 32 and the following roller 34, to the appropriate nip pressure Nt corresponding to the friction coefficient μ of the web W, for the web W having large basis weight and high friction coefficient μ and for the web W having small basis weight and low friction coefficient μ.

Moreover, when the web roll 12 set on the web roll support shaft 11 of the unwinder 2 is replaced, the printing apparatus 1 of the embodiment sets the appropriate nip pressure Nt to a sum of the adjustment pressure α and the nip pressure Ns in the case where the numbers of pulses in the respective outputs ENC1 and ENC2 of the encoders 35 and 36 of the conveyance roller 32 and the following roller 34 are approximately the same (ENC1≈ENC2).

Accordingly, even when the outputs ENC1 and ENC2 of the encoders 35 and 36 of the conveyance roller 32 and the following roller 34 actually vary and become unequal while the entire web W of one new web roll 12 is conveyed and nipped by the conveyance roller 32 and the following roller 34 at, for example, the nip pressure Ns, the printing apparatus 1 can maintain the state where the web W is nipped at the appropriate nip pressure corresponding to the friction coefficient μ and provide appropriate tension to the web W conveyed by the conveyance unit 31.

Although the printing apparatus 1 is described to have a configuration including the unwinder 2 and the rewinder 5 in the aforementioned embodiment, the printing apparatus 1 may have such a configuration that a rewinding apparatus and an unwinding apparatus are connected to the printing apparatus as external apparatuses.

Moreover, although the rewinding motor 67 of the rewinder 5 applies the tension T1 in the reverse direction toward the unwinder 2 to the web W in the aforementioned embodiment, the present invention can be applied to the printing apparatus 1 having such a configuration that the brake unit 50 applies the tension T1 in the reverse direction to the web W.

Furthermore, although the case of adjusting the nip pressure applied by the conveyance roller 32 and the following roller 34 to the web W conveyed from the unwinder 2 to the rewinder 5 is described in the aforementioned embodiment, the present invention can be carried out to adjust a nip pressure applied by rollers, for example, when cut sheets cut into A4 size, B5 size, or the like are conveyed.

In this case, the nip pressure adjustment processing in the flowchart of FIG. 5 which is performed when the web roll 12 is replaced in the aforementioned embodiment can be performed, for example, when the cut sheets are loaded on a sheet tray.

Moreover, the adjustment pressure α added to the current nip pressure Na can be determined by using, as a guide, for example, the degree of variation (variation width) in the difference between the outputs ENC1 and ENC2 of the encoders 35 and 36 of the conveyance roller 32 and the following roller 34 in the case where the cut sheets of the maximum capacity of the sheet tray are conveyed at a prescribed speed while the nip pressure N is maintained at the nip pressure Ns at which the outputs ENC1 and ENC2 of the encoders 35 and 36 of the conveyance roller 32 and the following roller 34 are approximately the same.

In this case, the adjustment pressure α may be updated to a new value every time the CPU of the controller 6 determines the degree of variation (variation width) in the difference between the outputs ENC1 and ENC2 of the encoders 35 and 36 of the conveyance roller 32 and the following roller 34 while the cut sheets of the maximum capacity of the sheet tray are conveyed.

Although the configuration in which the position of the rotary shaft 32*a* of the conveyance roller 32 is fixed is described in the aforementioned embodiment, a nip pressure adjustment mechanism which adjusts a contact pressure of the conveyance roller 32 on the following roller 34 similar to the nip pressure adjustment mechanism 37 may be provided. In this case, the nip pressure adjustment mechanism may be configured to apply a biasing force of a spring or the like to, for example, a unit formed by integrating the conveyance roller 32 and the conveyance motor 33.

A conveying apparatus according to some embodiments has, for example, the following configurations. A conveying apparatus (for example, the conveyor 3 and the controller 6 of FIG. 1) includes: a first roller (for example, the conveyance roller 32 of FIG. 1) and a second roller (for example, the following roller 34 of FIG. 1) configured to convey a print sheet (for example, the web W of FIG. 1) while nipping the print sheet at a nip pressure; an adjustor (for example, the nip pressure adjustment mechanism 37 of FIG. 2) supporting the first roller and the second roller in a manner capable of adjusting an inter-axial distance (for example, the distance between the rotary shaft 32*a* of the conveyance roller 32 and the rotary shaft 34*a* of the following roller 34 of FIG. 2) between the first roller and the second roller, the adjustor being configured to apply a biasing force biasing the second roller toward the first roller and capable of adjusting the biasing force; and a controller configured to control the nip pressure by driving the adjustor to adjust the biasing force.

In the aforementioned configuration, when the print sheet is conveyed by the first and second rollers with certain tension applied thereto, it is possible to prevent one of the rollers from slipping on the print sheet and rotating at a smaller rotation amount than the other roller and the first and second rollers can nip the conveyed print sheet at an appropriate nip pressure and apply appropriate tension to the conveyed print sheet.

In the conveying apparatus, the print sheet may be a roll sheet (for example, the web W of FIG. 1) fed from an unwinder (for example, the unwinder 2 of FIG. 1) and rewound by a rewinder (for example, the rewinder 5 of FIG. 1).

In the aforementioned configuration, the first and second rollers nipping and conveying the roll sheets from the unwinder to the rewinder can apply appropriate tension to the conveyed roll sheet.

In the aforementioned conveying apparatus, the controller may be configured to control the nip pressure such that the nip pressure equals to a value (for example, the nip pressure Ns of FIG. 5, the nip pressure Na+sβ of FIG. 6) determined based on a first rotation amount of the first roller (for example, the number of pulses in the output ENC1 of the encoder 35 of FIG. 1) and a second rotation amount of the second roller (for example, the number of pulses in the output ENC2 of the encoder 36 of FIG. 1).

In the aforementioned configuration, it is possible to determine presence or absence of slipping of each roller on the print sheet from the rotation amounts of the first and second rollers nipping the conveyed print sheet and control the nip pressure of the first and second rollers such that the nip pressure equals to a nip pressure at which the conveyed print sheet is completely nipped without the slipping of the rollers.

In the aforementioned conveying apparatus, the controller may be configured to control the nip pressure such that the nip pressure equals to a value (for example, the nip pressure Na−(β−n) of FIG. 6 in the case where the numbers of pulses in the respective outputs ENC1 and ENC2 of the encoders 35 and 36 of FIG. 1 are approximately the same) at which the difference between the first rotation amount of the first roller and the second rotation amount of the second roller is within a prescribed range.

In the aforementioned configuration, the nip pressure of the first and second rollers can be controlled to be a nip pressure at which the first and second rollers nipping the conveyed print sheet completely nip the conveyed print sheet without slipping on the print sheet.

In the aforementioned conveying apparatus, upon a change in type of the print sheet (for example, when the web roll 12 on the web roll support shaft 11 of FIG. 1 is replaced), the controller may be configured to control the nip pressure such that the nip pressure equals to a sum (for example, the appropriate nip pressure Nt in FIG. 5) of a first value and a second value, the first value being a value at which a difference between the first rotation amount of the first roller and the second rotation amount of the second roller is within the prescribed range (for example, the nip pressure Nm of FIG. 5 in the case where the numbers of pulses in the outputs ENC1 and ENC2 of the encoders 35 and 36 of FIG. 1 are approximately the same), the second value being an adjustment value (for example, the adjustment pressure α of FIG. 5) depending on a variation in the difference which occurs while a reference amount of print sheet is conveyed (for example, while the entire web W of one web roll 12 is conveyed at the prescribed speed with the nip pressure maintained at a nip pressure Nm at which the outputs ENC1 and ENC2 of the encoders 35 and 36 of FIG. 1 are approximately the same).

In the aforementioned configuration, even in a situation where the type of the print sheet is changed and the nip pressure at which the pair of rollers completely nip the conveyed sheet may change during the conveyance of the sheet, the nip pressure of the pair of rollers can be controlled to be a nip pressure at which the pair of rollers apply appropriate tension to the conveyed print sheet without slipping.

In the aforementioned conveying apparatus, the adjustor may include a pressure application spring (for example, the pressure application spring 39, 40 of FIG. 2) and be configured to adjust the biasing force by changing a spring force of the pressure application spring.

Embodiments of the present invention have been described above. However, the invention may be embodied in other specific forms without departing from the spirit or essential characteristics thereof. The present embodiments are therefore to be considered in all respects as illustrative and not restrictive, the scope of the invention being indicated by the appended claims rather than by the foregoing description and all changes which come within the meaning and range of equivalency of the claims are therefore intended to be embraced therein.

Moreover, the effects described in the embodiments of the present invention are only a list of optimum effects achieved by the present invention. Hence, the effects of the present invention are not limited to those described in the embodiment of the present invention.

What is claimed is:

1. A conveying apparatus comprising:

a first roller and a second roller configured to convey a print sheet while nipping the print sheet at a nip pressure;

an adjustor supporting the first roller and the second roller in a manner capable of adjusting an inter-axial distance between the first roller and the second roller, the adjustor being configured to apply a biasing force biasing the second roller toward the first roller and capable of adjusting the biasing force; and a controller configured to control the nip pressure by driving the adjustor to adjust the biasing force, wherein the controller is configured to control the nip pressure such that the nip pressure equals to a value determined based on a first rotation amount of the first roller and a second rotation amount of the second roller.

2. The conveying apparatus according to claim 1, wherein the adjustor comprises a pressure application spring and is configured to adjust the biasing force by changing a spring force of the pressure application spring.

3. The conveying apparatus according to claim 1, wherein the print sheet is a roll sheet fed from an unwinder and rewound by a rewinder.

4. The conveying apparatus according to claim 1, wherein the controller is configured to detect slipping of the print sheet at the nip; and the controller adjusts the nip pressure to stop slipping of the print sheet at the nip when the controller detects slipping of the print sheet at the nip.

5. The conveying apparatus according to claim 1, wherein the first roller comprises a conveyance roller driven by a motor to convey the print sheet, and the second roller comprises a following roller configured to be driven by the conveyance roller to convey the print sheet while nipping the print sheet at a nip pressure.

6. The conveying apparatus according to claim 1, wherein the adjustor comprises one or more of:

a) two spaced apart pressure application arms supporting a rotary shaft of the second roller;

b) a pivotable adjustor that is pivotable about a supporting shaft spaced from the rotary shaft of the second roller, so that when the adjustor pivots in a predetermined direction around the supporting shaft, the adjustor pushes the second roller toward the first roller;

c) two spaced apart adjustment arms, each connected to one of the pressure application arms by first and second springs, respectively, and each pivotable about the supporting shaft, wherein pivoting of the adjustment arms around the supporting shaft changes the biasing force of the springs on swinging ends of the pressure application arms and changes the inter-axial distance between the first and second rollers; and d) an adjustment motor that drives a worm gear to swing the adjustment arms around the supporting shaft by causing a worm attached to an output shaft of the adjustment motor to rotate the supporting shaft via a worm wheel in mesh with the worm, thereby changing the spring forces of the springs, which adjusts the nip pressure applied to a web comprising the print sheet by the first and second rollers.

7. A conveying apparatus comprising:

a first roller and a second roller configured to convey a print sheet while nipping the print sheet at a nip pressure;

an adjustor supporting the first roller and the second roller in a manner capable of adjusting an inter-axial distance between the first roller and the second roller, the adjustor being configured to apply a biasing force biasing the second roller toward the first roller and capable of adjusting the biasing force; and a controller configured to control the nip pressure by driving the adjustor to adjust the biasing force, wherein the controller is configured to control the nip pressure such that the nip pressure equals to a value at which a difference between a first rotation amount of the first roller and a second rotation amount of the second roller is within a prescribed range.

8. A conveying apparatus comprising:

a first roller and a second roller configured to convey a print sheet while nipping the print sheet at a nip pressure;

an adjustor supporting the first roller and the second roller in a manner capable of adjusting an inter-axial distance between the first roller and the second roller, the adjustor being configured to apply a biasing force biasing the second roller toward the first roller and capable of adjusting the biasing force; and a controller configured to control the nip pressure by driving the adjustor to adjust the biasing force, wherein upon a change in type of the print sheet, the controller is configured to control the nip pressure such that the nip pressure equals to a sum of a first value and a second value, the first value being a value at which a difference between a first rotation amount of the first roller and a second rotation amount of the second roller is within a prescribed range, the second value being an adjustment value depending on variation in the difference which occurs while a reference amount of the print sheet is conveyed.

* * * * *